United States Patent [19]

Jamison

[11] 4,157,878

[45] Jun. 12, 1979

[54] CONNECTING APPARATUS FOR HINGEDLY AND SLIDABLY CONNECTING AN ATTACHMENT TO SELF-PROPELLED MINE VEHICLE

[75] Inventor: Will B. Jamison, Bethel Park, Pa.

[73] Assignee: Consolidation Coal Company, Pittsburgh, Pa.

[21] Appl. No.: 883,161

[22] Filed: Mar. 3, 1978

[51] Int. Cl.[2] ..... E21C 11/02

[52] U.S. Cl. ..... 405/303; 405/259; 173/23; 299/33

[58] Field of Search ..... 61/63, 45 B, 45 D; 173/23, 22; 299/33; 280/150 R, 150 S, 150 F, 150.5

[56] References Cited

U.S. PATENT DOCUMENTS

| | | | |
|---|---|---|---|
| 3,842,610 | 10/1974 | Willis et al. | 61/45 D X |
| 3,951,215 | 4/1976 | Galis | 173/23 |
| 4,079,792 | 3/1978 | Paul et al. | 173/23 |
| 4,082,360 | 4/1978 | Campbell et al. | 61/45 D |

*Primary Examiner*—Jacob Shapiro
*Attorney, Agent, or Firm*—William A. Mikesell, Jr.; Stanley J. Price, Jr.

[57] ABSTRACT

An attachment, such as an operator's compartment or a mine roof drilling and bolting assembly is positioned adjacent the body portion of a self-propelled mine vehicle with the bottom portion of the attachment in slidable contact with the mine floor. In one embodiment a slide assembly for supporting the attachment for upward and downward movement relative to the mine vehicle is pivotally connected by a hinge assembly to the vehicle body. With this arrangement the attachment is operable to move upwardly and downwardly relative to the hinge assembly, which is fixed to the vehicle body. The attachment is operable to pivot about the hinge assembly as the bottom portion of the attachment slides along the undulating surface of the mine floor. In another embodiment the hinge assembly is secured to the attachment and supports guide rails of the slide assembly which are slidably received within a guide member secured to the vehicle body. With this arrangement the hinge assembly moves upwardly and downwardly with the attachment as the guide rails slide in the guide member. The attachment is also arranged by operation of a piston cylinder assembly to be tilted to a preselected position where only the front edge of the rear edge of the attachment bottom portion slides on the mine floor.

23 Claims, 15 Drawing Figures

CONNECTING APPARATUS FOR HINGEDLY AND SLIDABLY CONNECTING AN ATTACHMENT TO SELF-PROPELLED MINE VEHICLE

BACKGROUND OF THE INVENTION

1. Field of the Invention

This invention relates to apparatus for hingedly and slidably connecting an attachment to a self-propelled mine vehicle and more particularly to a connecting device that hingedly and slidably connects an attachment to the body portion of the mine vehicle to permit the attachment to pivot and to move upwardly and downwardly and thereby remain in slidable contact with the mine floor independent of the movement of the vehicle body portion as it travels over the undulating surface of the mine floor.

2. Description of the Prior Art

Self-propelled haulage vehicles, such as shuttle cars, are used in mines for transporting dislodged material from a mining or loading machine out of the mine. The shuttle car includes a longitudinally extending compartment in which the mined material is loaded and after loading the shuttle car moves from an area adjacent the mine face to a fixed haulage system such as an endless conveyor where the coal is discharged from the shuttle car onto a conveyor belt.

The shuttle car is controlled from an operator's compartment that is rigidly secured to the sidewall of the vehicle. An example of such arrangement is disclosed in U.S. Pat. No. 3,067,830. Suitable controls are provided on the operator's compartment by which the operator controls the movement of the vehicle between the mine face and the discharge point. Also, operation of the conveyor in the haulage compartment is controlled from the operator's compartment.

The machine operator in the operator's compartment is exposed to the mine roof and is, therefore, subject to serious injury from falling debris. Mine safety requirements now require that the machine operator be protected from overhead debris falling from the mine roof. Thus it has become the practice to utilize overhead canopies for protecting operators of various equipment in a mine from the hazard of roof falls. For a shuttle car, however, the limited overhead clearance of the operator's compartment hinders the installation of the canopy particularly when the car is operated in a mine seam having a height of less than 40 inches. With the operator's compartment fixed on the vehicle and raised above the mine floor to provide the necessary ground clearance between the bottom of the compartment and the mine roof, there is insufficient clearance above the top of the shuttle car for the installation of an overhead protective canopy. Furthermore, when there is little clearance between the top of the canopy and the mine roof, the canopy will strike the mine roof as the shuttle car moves upwardly and downwardly as it travels over the undulating surface of the mine floor.

U.S. Pat. No. 4,022,026 discloses a machine used in coal mines with a pivotally supported canopy over an operator's station for protecting a machine operator from falling debris. The canopy is pivotally connected at one end to the machine body portion for limited upward movement toward the mine roof. The opposite or free end of the canopy is connected to the free end of a platform by a pair of hydraulic jacks. The platform, in turn, is pivotally connected at the other end to the machine body portion. The free end of the platform is supported from the canopy by the pair of hydraulic jacks. When the jacks are in a retracted position, the free end of the platform is spaced from the mine floor. When it is desired to move the canopy into abutting relation with the mine roof, the jacks are extended to move the free end of the platform into abutting relation with the mine floor and the free end of the canopy into abutting relation with the mine roof. The canopy thus provides roof support for the operator positioned on the platform. It is stated that the free end of the platform can remain in abutting relation with the mine floor when the machine is stationary or moved for short distances. It is, however, believed that the apparatus disclosed with the free end of the platform in contact with the mine floor is not suitable for vehicles that travel long distances over an undulating surface and an undesirable plowing action would occur between the free end of the platform and the mine floor when the platform is moved rearwardly with the machine.

U.S. Pat. No. 4,078,629 discloses an operator's compartment having a bottom portion positioned to rest entirely upon the mine floor and slide along the surface of the mine floor as the haulage vehicle is propelled. The operator's compartment is slidably supported on a sidewall of the vehicle to move upwardly and downwardly independently of the upward and downward movement of the vehicle as it travels over the uneven surface of the mine floor. With this arrangement the additional overhead clearance necessary to install a canopy above the compartment is provided by positioning the compartment for slidable movement on the mine floor.

It is also known to pivotally connect the front end portion of a canopied operator's compartment to a mining machine with the rear end portion resting on the mine floor. With this arrangement the rear end portion drags on the mine floor as the mining machine advances in the mine entry. When the mining machine advances, the front end of the machine tends to dip downwardly raising the rear end of the machine. With the pivotal arrangement the compartment rear end portion remains on the mine floor so that the canopy does not strike the mine roof. The front end of the operator's compartment is, however, connected to the mining machine so that the upward and downward movement of the mining machine is transmitted to the operator's compartment through the pivot connection. The canopy may be vertically fixed to extend a preselected height above the operator's compartment.

While it has been suggested by the prior art devices to pivotally connect an operator's station to the body portion of a self-propelled mine vehicle and to slidably connect an operator's compartment to the vehicle mobile body portion for upward and downward movement relative thereto so that the compartment may remain in slidable contact with the mine floor as the vehicle is advanced, there is need for a connecting device that is operable to secure an attachment, such as a roof drilling and bolting unit and the like, to the body of a self-propelled mine vehicle to permit the attachment to remain in slidable contact with the mine floor. However, the connection between the attachment and the vehicle body must permit the attachment to move independently of the vehicle body to remain in contact with the mine floor as the vehicle travels over the undulating surface of the mine floor.

SUMMARY OF THE INVENTION

In accordance with the present invention there is provided a self-propelled vehicle for use in a mine that includes a mobile body that is provided with traction devices for propelling the mobile body along a mine floor. An attachment is positioned adjacent to the mobile body and includes a bottom portion. A connecting device extends between the attachment and the mobile body and is operable to slidably and hingedly connect the attachment to the mobile body to permit the attachment to move upwardly and downwardly relative to the mobile body and to pivot relative to the mobile body as the attachment bottom portion travels over the uneven surface of the mine floor.

The mobile body may include a self-propelled mine vehicle, such as a mine loader, mining machine or the like, where the attachment may include an automated roof drilling and bolting unit which carries a roof drill and a quantity of roof bolts which are vertically stored on the unit and individually fed into position in the roof drill for installation in the mine roof. Preferably one or more of such attachments are positioned adjacent the mobile body. For each attachment a first portion of the connecting device is connected to the mobile body and a second portion is connected to the attachment. The first and second portions are pivotally connected to each other about a pivotal axis that extends between the attachment and the mobile body. With this arrangement the attachment is operable to pivot relative to the mobile body to permit the bottom portion of the attachment to slide along the mine floor as the mobile body with the attachment connected thereto travels over the undulating surface of the mine floor.

Preferably, the pivotal axis is positioned horizontally and transversely between the attachment and the mobile body. Thus, pivotal movement of the attachment relative to the mobile body is actuated by movement of the mobile body over the uneven surface of the mine floor. However, in one embodiment of the present invention a piston cylinder assembly mounted on either the mobile body or the attachment is connected to the connecting device and is operable to pivot the attachment so that the front or rear edge of the bottom portion of the attachment is positioned in slidable contact with the mine floor. The piston cylinder assembly is operable to maintain the attachment in a preselected pivoted position.

The connecting device includes a hinge assembly and a slide assembly with the hinge and slide assemblies connected to each other. The attachment may include in addition to a roof drilling and bolting unit an operator's compartment, a cable reel or any other device that is carried by a self-propelled mine vehicle in a manner where it is advantageous to support the attachment to slide along the mine floor and provide maximum overhead clearance between the attachment and the mine roof.

In one embodiment the hinge assembly is secured to the attachment and is pivotally connected to the slide assembly which is connected to the mine vehicle. The slide assembly includes a plurality of vertically extending guide rails that are connected to a pivotal portion of the hinge assembly and are arranged for slidable movement within vertical guideways of a guide member that is secured to the mine vehicle. The hinge assembly moves upwardly and downwardly with the attachment as the bottom of the attachment slides on the mine floor. In the event the attachment bottom portion encounters an abrupt change in the elevation of the mine floor, the hinge assembly permits the attachment to pivot relative to the mine vehicle.

In another embodiment of the invention one portion of the hinge assembly is secured to the mine vehicle, and the guide member of the slide assembly is pivotally connected to the hinge assembly. The guide rails of the slide assembly are secured to the attachment and are slidably received within guideways of the guide member for upward and downward movement relative thereto. The hinge assembly provides a pivotal axis for pivotal movement of the attachment relative to the mine vehicle as the attachment slides over the uneven surface of the mine floor. With this arrangement, however, the hinge assembly moves upwardly and downwardly with the mine vehicle independently of the upward and downward movement of the attachment.

Accordingly, the principal object of the present invention is to provide an attachment for a self-propelled mine vehicle that is slidably and hingedly connected to the vehicle to facilitate pivotal and upward and downward movement of the attachment relative to the vehicle so that the attachment may slide on the mine floor as the vehicle is propelled over the undulating surface of the mine floor.

Another object of the present invention is to provide a connecting device for securing an attachment, such as an automated roof drilling and bolting unit, to a self-propelled mine vehicle to permit pivotal and upward and downward movement of the unit as it slides on the uneven surface of a mine floor independently of the upward and downward movement of the vehicle so that the unit remains in contact with the mine floor to provide during tramming additional overhead clearance between the top of the unit and the mine roof.

Another object of the present invention is to provide apparatus for connecting an attachment to a self-propelled vehicle to permit vertical and pivotal movement of the attachment relative to the vehicle and to pivot the attachment to a position where an edge portion of the bottom of the attachment is arranged to slide on the mine floor as the vehicle is propelled.

These and other objects of the present invention will be more completely disclosed and described in the following specification, the accompanying drawings and the appended claims.

DESCRIPTION OF THE PREFERRED EMBODIMENTS

Figures 1, 2, 3:
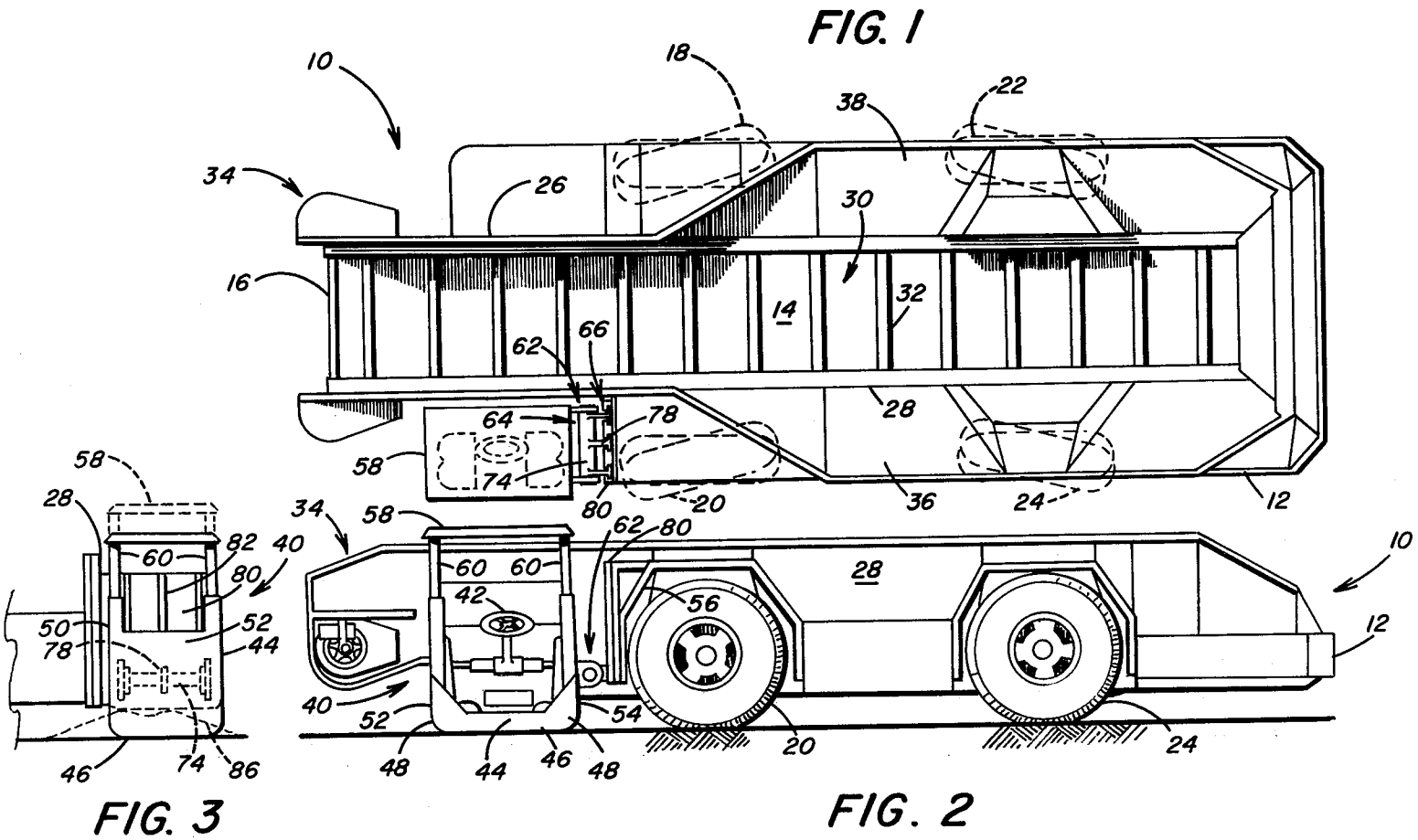
FIG. 1 is a top plan view of a mine haulage vehicle, illustrating an operator's compartment that is hingedly and slidably connected to the body of the vehicle for slidable movement along the surface of the mine floor.
FIG. 2 is a view in side elevation of the mine haulage vehicle shown in FIG. 1, illustrating a hinge and slide connection between the operator's compartment and the vehicle with the hinge connection secured to the compartment for upward and downward movement with the compartment relative to the vehicle.
FIG. 3 is a fragmentary end view of the haulage vehicle, illustrating the operator's compartment and in phantom the compartment moved upward on the vehicle as it slides over an elevated portion of the mine floor.
Figure 4:
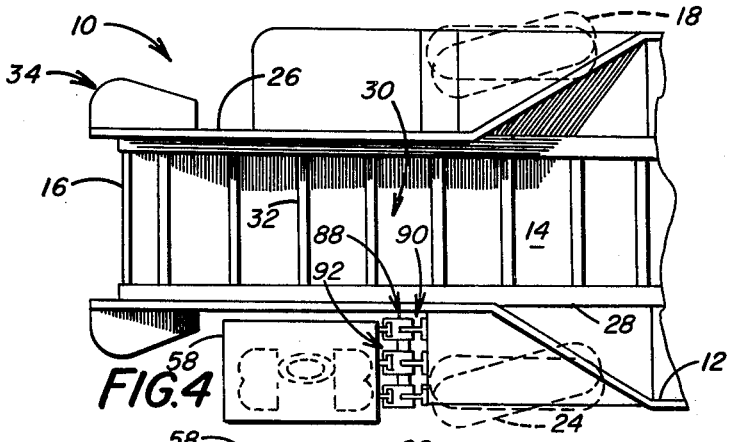
FIG. 4 is a fragmentary top plan view of a haulage vehicle, illustrating another embodiment of the connection for hingedly and slidably attaching an operator's compartment to the vehicle with the hinged connection secured to the vehicle.

Referring to the drawings and particularly to FIGS. 1–3 there is illustrated a mine haulage vehicle such as a shuttle car, generally designated by the numeral 10, that includes a body portion 12, a material receiving compartment 14 and a material discharge end portion 16. The body portion 12 is mounted on a pair of front traction wheels 18 and 20 and a pair of rear traction wheels 22 and 24. The wheels 18 and 20 are mounted adjacent to sidewalls 26 and 28 of the body 12 with the haulage compartment 14 extending therebetween. The haulage compartment 14 has a conventional endless flight conveyor 30 extending along the bottom portion of the compartment.

The flight conveyor 30 includes a plurality of cross flights 32 that are propelled by suitable side chains (not shown). The discharge end of the conveyor 30 extends along a tiltable end frame or boom 34 which is pivotally arranged to effect a variation in the discharge height of the vehicle discharge end portion 16. The endless conveyor 30 is propelled by a pair of sprockets that are secured to a cross shaft which is propelled by a suitable prime mover. Further details of the shuttle car 10 which are not a part of the present invention are illustrated and described in U.S. Pat. No. 3,067,830.

The haulage vehicle or shuttle car 10 has adjacent the discharge end portion 16 and at one side of the material receiving compartment 14, a compartment 36 in which a conventional prime mover is positioned. A second prime mover, as desired, may be positioned on the opposite side of the haulage vehicle in a compartment 38 between the wheels 18 and 20. Associated with the vehicle body portion 12 is an attachment, such as an operator's compartment, generally designated by the numeral 40. The operator's compartment 40 is positioned adjacent the discharge end portion 16 and is hingedly and slidably connected to the vehicle body portion in accordance with the present invention, as illustrated in FIGS. 1–10. Other attachments, such as roof drilling and bolting units, are operable to be hingedly and slidably connected to a mobile mine vehicle, in a manner similar to the above arrangement of connecting an operator's compartment to a shuttle car in accordance with the present invention, as illustrated in FIGS. 11–15 and described hereinafter in greater detail. An attachment such as an automated drilling and bolting machine is particularly adaptable with the present invention because the roof bolts are stored in a vertical position for feeding to the drill pod and the unit therefore has a fixed vertical dimension. By hingedly and slidably connecting the automated unit to the mobile vehicle, the unit is operable to slide on the mine floor and added clearance is obtained between the mine roof and the top of the unit.

The operator's compartment 40 serves as a station for the operator and includes a conventional steering wheel 42 and the other necessary controls by which the vehicle is operated. The compartment 40 has a body portion 44 and a bottom portion or floor 46 that is connected to the body portion 44 by the rounded edge portions 48. The compartment body portion 44 includes a vertical sidewall 50 positioned adjacent to the vehicle sidewall 28. The opposite side of compartment 40 is open to provide ingress and egress into and out of the compartment. The compartment is enclosed by front and rear end walls 52 and 54. The rear end wall 54 is positioned adjacent to wheel fender 56 that extends outwardly from the vehicle body portion sidewall 28.

A protective overhead canopy 58 overlies the operator's compartment 40 and is supported thereabove by vertical members 60 that extend upwardly from the body portion 44. The members 60 are vertically adjustable as described in greater detail in United States Application Ser. No. 690,364 to effect variations in the height of the canopy 58 above the compartment body portion 44. The operator's compartment 40 is hingedly and slidably connected to the vehicle body portion 12 by a connecting apparatus generally designated by the numeral 62 secured to the compartment rear end wall 54 and the wheel fender 56. It should be understood however, that the connecting apparatus 62 is also applicable for connecting the drilling and bolting unit of FIG. 11 to a mobile mine vehicle.

Figure 9:
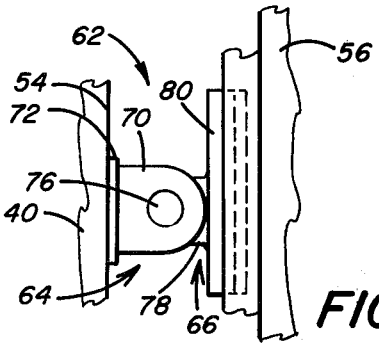
FIG. 9 is an enlarged fragmentary view in side elevation of the hinge and slide connection shown in FIGS. 1–3, illustrating the hinge connection secured to the compartment and guide rails vertically movable in guideways of a guide member secured to the haulage vehicle.
Figure 10:
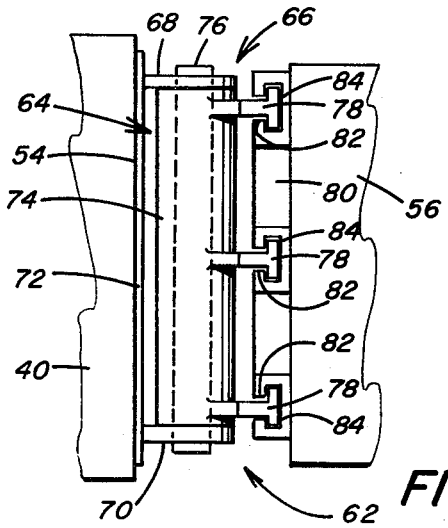
FIG. 10 is a fragmentary top plan view of the hinge and slide connection illustrated in FIG. 9.

The connecting apparatus 62 illustrated in FIGS. 1–3 is illustrated in greater detail in FIGS. 9 and 10 and includes a hinge assembly generally designated by the numeral 64. The hinge assembly 64 is secured to the operator's compartment rear end wall 54. A slide assembly generally designated by numeral 66 is connected to the hinge assembly 64 and to the wheel fender 56 of the vehicle 10. With this arrangement the operator's compartment 40 is pivotally connected by the hinge assembly 64 to the slide assembly 66 so that the compartment 40 is operable to pivot and move upwardly and downwardly as the vehicle 10 travels over the uneven surface of the mine floor and the bottom portion 46 of the compartment body portion 44 slides on the mine floor.

The hinge assembly 64 includes a pair of flange members 68 and 70 that are positioned in spaced relation and are secured, as by welding, to a mounting plate 72 that is suitably connected to the compartment rear end wall 54. Positioned between the flange members 68 and 70 is a trunnion 74 having an axial bore extending therethrough. The axial bore of the trunnion 74 is aligned with bores in the flange members 68 and 70. The aligned bores are arranged to receive a pivot pin 76. With this arrangement the pivot pin 76 pivotally connects the trunnion 74 to the flange members 68 and 70. The pivot pin 76 thus forms a horizontal pivotal axis about which the operator's compartment 40 is arranged to pivot relative to the vehicle body portion 12.

The slide assembly 66 illustrated in detail in FIGS. 9 and 10 includes a plurality of T-shaped guide rails 78 that are suitably secured at one end portion to the trunnion 74. Securely mounted to the vehicle wheel fender 56 is a guide member 80 having a plurality of spaced parallel, vertically extending guideways 82. Each of the guideways 82 includes an expanded recess portion 84 that is arranged to slidably receive the T-shaped end portion of the vertically extending guide rails 78. The recess portions 84 of the guideways 82 have a configuration corresponding to the T-shaped configuration of the end portion of the guide rails 78, as illustrated in FIG. 10.

The T-shaped end portions of the guide rails 78 are slidably positioned within the recess portions 84 to permit upward and downward movement of the guide rails 78 within the guideways 82. With this arrangement the operator's compartment 40 having the hinge assembly 64 connected thereto is supported for vertical movement on the vehicle wheel fender 56 by connection of the guide rails 78 with the guideways 82. Thus as the vehicle 10 travels along the mine floor and encounters an undulating surface of the mine floor, the operator's compartment 40 is free to "float" relative to the vehicle body portion 12 and the compartment body portion 46 remains in contact with the mine floor.

As the vehicle 10 travels over an elevated portion of the mine floor and moves upwardly, the trailing operator's compartment 40 remains in contact with the mine floor by virtue of the slidable engagement of the guide rails 78 with the guideways 82. The vehicle body portion 12 is permitted to move upwardly relative to the compartment 40 which remains on the mine floor. Further, when the operator's compartment 40 encounters an elevated portion of the mine floor, such as a mound 86 illustrated in FIG. 3, the operator's compartment is free to move upwardly relative to the vehicle body portion 44 to permit the compartment bottom portion 46 to follow the elevated contour of the mound 86.

Not only is the operator's compartment 40 free to move upwardly and downwardly relative to the vehicle body portion 12, it is also operable by the hinge assembly 64 to pivot about the horizontal pivotal axis provided by the pivot pin 76 relative to the vehicle body portion 12. This arrangement maintains the guide rails 78 freely movable within the guideways 82. Also as illustrated in FIGS. 1–3 and 9 and 10, the hinge assembly 64 is movable upwardly and downwardly with the operator's compartment. This permits the operator's compartment 40 to pivot relative to the vehicle body portion 12, as well as move upwardly and downwardly relative to the body portion 12.

In the embodiment of the invention illustrated in FIGS. 4–8, a connecting apparatus 88 hingedly and slidably connects the operator's compartment 40 to the vehicle body portion 12. The connecting apparatus 88 includes a hinge assembly 90 that is fixedly secured to the vehicle body portion 12. A slide assembly 92 is secured to the compartment 40 and connected to the hinge assembly 90. With this arrangement the compartment 40 is operable to move upwardly and downwardly relative to the hinge assembly 90 and the vehicle 10.

Figure 7:
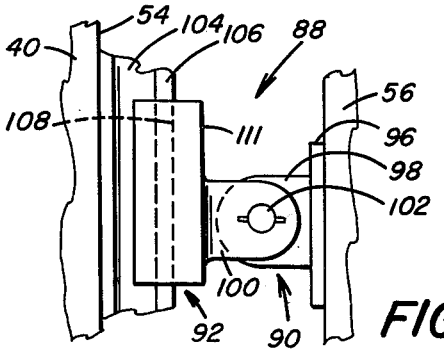
FIG. 7 is an enlarged fragmentary view in side elevation of the hinge and slide connection shown in FIGS. 4–6, illustrating the hinge connection secured to the haulage vehicle and the guide rails movable in guideways on the hinge connection for upward and downward movement of the compartment.
Figure 8:
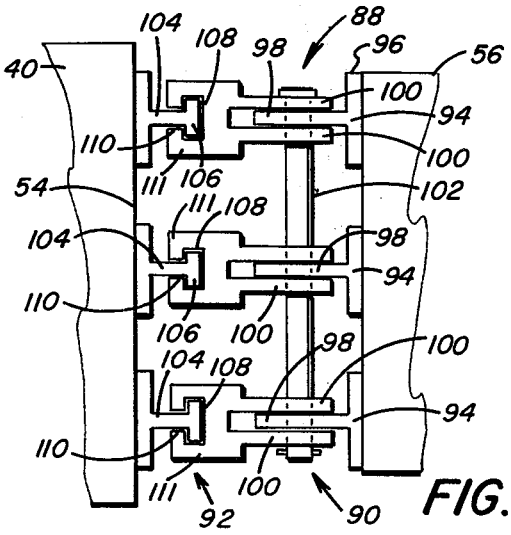
FIG. 8 is a fragmentary top plan view of the hinge and slide connection illustrated in FIG. 7.

The hinge assembly 90 of the connecting apparatus 88, illustrated in FIGS. 7 and 8, includes a plurality of spaced flange members 94 each having a base 96 which is suitably secured, as by welding or bolting, to the body portion wheel fender 56 and an outwardly extending portion 98 having a bore therethrough. The hinge assembly 90 also includes clevis members 100 that are positioned in surrounding relation with the extending portions 98 of the flange members 94. Each clevis member 100 has a bore therethrough, which bore is aligned with the respective bore through the outwardly extending portion 98. A pivot pin 102 extends through the aligned bores of the flange members 94 and the clevis members 100. This arrangement permits the clevis members 100 to pivot about the horizontal pivotal axis of the pivot pin 102.

The slide assembly 92 for slidably supporting the operator's compartment 40 for upward and downward movement relative to the vehicle body portion 12 includes a plurality of spaced parallel, vertical extending guide rails 104. Each guide rail 104 has a base portion that is suitably secured to the rear end wall 54 of the operator's compartment 40 and a body portion 106 having a T-bar configuration positioned for slidable upward and downward movement within a recess 108 of guideway 110 provided within guide member 111 which is secured to the adjacent end portion of the clevis member 100.

Figure 6:
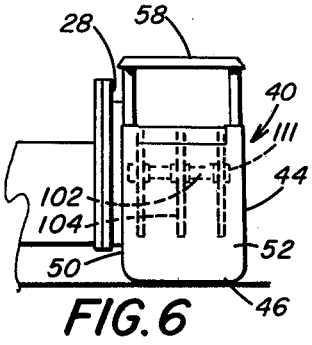
FIG. 6 is a fragmentary end view of the haulage vehicle shown in FIG. 5, illustrating the slide connection for supporting the compartment for upward and downward movement on the vehicle.
Figure 5:
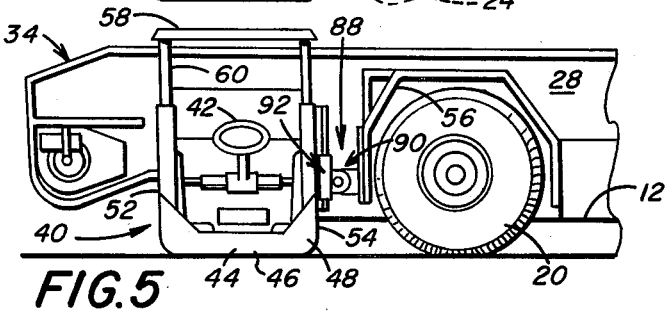
FIG. 5 is a fragmentary view in side elevation of the haulage vehicle shown in FIG. 4, illustrating the compartment slidably positioned on the mine floor.

As illustrated in FIGS. 5 and 6 the operator's compartment bottom portion 46 is positioned in contact with the mine floor. As the vehicle 10 travels over the uneven surface of the mine floor, the guide rails 104 move upwardly and downwardly within the recesses 108 to permit the operator's compartment 40 to move upwardly and downwardly relative to the mobile body portion 12 and thereby follow the contour of the mine floor. As stated hereinabove the principal advantage of supporting the operator's compartment 40 for slidable movement on the mine floor is to provide additional overhead clearance for the installation of the protective canopy 58 on the operator's compartment.

With the connecting apparatus 88 illustrated in FIGS. 4–8, the operator's compartment 40 is vertically, as well as pivotally, movable relative to the vehicle body portion 12. However, with this arrangement the horizontal pivotal axis formed by the pivot pin 102 remains fixed relative to the vehicle body portion 12. This is compared with the embodiment of the connecting apparatus 62 illustrated in FIGS. 1–3 where the pivotal axis formed by the pivot pin 76 is movable upwardly and downwardly with the operator's compartment 40 relative to the vehicle body portion 12. As illustrated in FIGS. 7 and 8, the flange members 94 of the hinge assembly 64 are secured to the wheel fender 56. The clevis members 100 are connected by the pin 102 to the flange members 94 to thereby permit the operator's compartment 40 to pivot about the horizontal axis formed by the pivot pin 102. Thus with this arrangement, in the event the vehicle 10 encounters an abrupt change in the elevation of the mine floor, the operator's compartment is operable to move vertically, as well as pivotally, relative to the vehicle and remain in contact with the mine floor independently of the upward and downward movement of the vehicle body portion 12.

Figure 11:
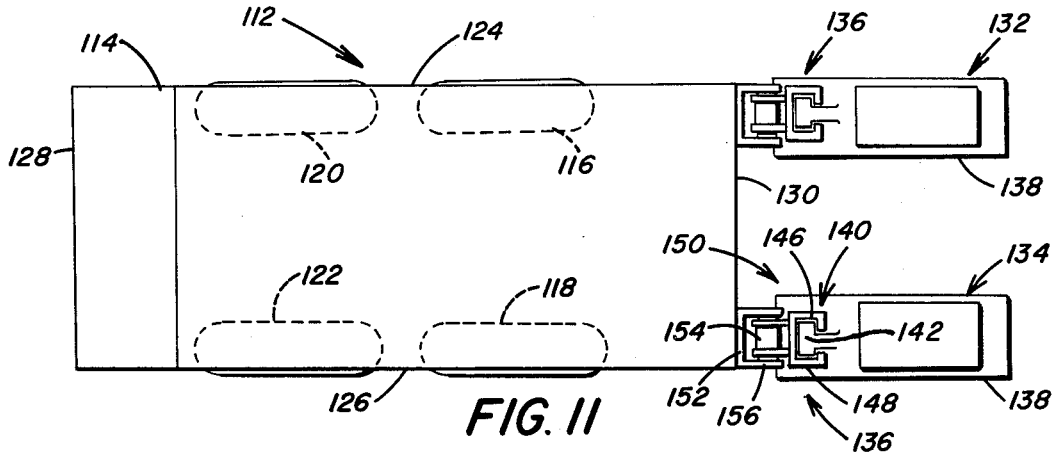
FIG. 11 is a schematic top plan view of a self-propelled mine vehicle having a pair of roof drilling and bolting units hingedly and slidably connected to the body of the vehicle.

Further, in accordance with the present invention, there is schematically illustrated in FIG. 11 a mobile drilling and bolting machine generally designated by the numeral 112 that includes a mobile body portion 114 that is propelled in a conventional manner as above discussed for the mine haulage vehicle 10. The body portion 114 is mounted on a pair of front traction wheels 116 and 118 and a pair of rear traction wheels 120 and 122. The wheels preferably are drivingly connected to a prime mover such as an electric motor (not shown).

The body portion 114 is formed by vertically extending sidewalls 124 and 126 connected to a pair of vertically extending endwalls 128 and 130. A pair of attachments, such as a pair of automated mine roof drilling and bolting assemblies generally designated by the numerals 132 and 134 are hingedly and slidably connected to the front wall 130 of the body portion 114 by connecting apparatus 136. With this arrangement the drilling and bolting assemblies 132 and 134 are positioned to remain in contact with the mine floor and slide along the surface of the mine floor as the mobile body portion 114 is propelled.

The automated mine roof drilling and bolting assemblies 132 and 134 are schematically illustrated in FIGS. 11–15; however, it should be understood that each of the assemblies are conventional and include a drill pod arranged to advance a drill steel vertically into the mine roof to drill a bolt hole. A plurality of conventional anchor-type roof bolts, as well as resin-type roof bolts, are stored vertically in a container on each assembly. Because the roof bolts and the drill steel are positioned vertically each assembly has a fixed vertical height. Therefore, by positioning each assembly for slidable movement on the mine floor added clearance is provided between the mine roof and the top of each assembly. Thus once the drill steel has been advanced into the mine roof to drill a bolt hole therein, the drill steel when retracted from the bolt hole is automatically replaced by a roof bolt in the drill pod. The roof bolt extending vertically is moved from its storage container into the chuck of the drill pod for advancement by the drill pod into the bolt hole in the mine roof.

Figure 12:
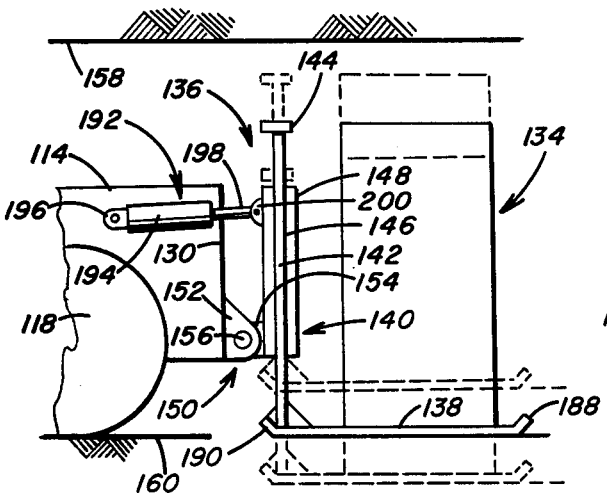
FIG. 12 is a fragmentary schematic view in side elevation of the vehicle shown in FIG. 11, illustrating a roof drilling and bolting unit hingedly and slidably connected to the vehicle so as to provide added clearance between the mine roof and the top of the unit.

As illustrated in FIG. 12, each drilling and bolting assembly is mounted on a platform or skid 138 that is positioned on the mine floor and arranged to slide on the mine floor as the machine 112 is advanced to the various locations of operation in the mine. The skid 138 is hingedly and slidably connected to the machine body portion 114 by the connecting apparatus 136. The connecting apparatus 136 includes a slide assembly generally designated by the numeral 140 with a guide rail 142 secured at one end portion to the skid 138 and extending upwardly therefrom to an opposite expanded end portion 144. The guide rail 142 is slidably received within a vertically extending recess 146 of a guide member 148.

The connecting apparatus 136 also includes a hinge assembly generally designated by the numeral 150 having a bracket portion 152 securely mounted to the end wall 130 of the machine body portion 114. A trunnion 154 of the hinge assembly 150 is secured to the guide member 148 and is positioned between the arms of the bracket portion 152 so that bores extending through the bracket portion 152 and trunnion 154 are aligned to receive a pivot pin 156. With this arrangement the trunnion 154 is connected to the bracket portion 152 for pivotal movement about a horizontal axis formed by the pivot pin 156.

As illustrated in FIG. 12, the slidable engagement of the guide rail 142 within the guide member 148 permits the skid 138 to move upwardly and downwardly relative to the machine body portion 114 in response to movement of the skid 138 over the contour of the mine floor. The upward and downward movement of the skid 138 is independent of the upward and downward movement of the machine body portion 114. The drilling and bolting assembly 134 is secured to the skid 138 and moves with the skid as illustrated in phantom in FIG. 12. Thus, it will be apparent by slidably and hingedly supporting the drilling and bolting assemblies 132 and 134 on the machine 112 for movement on the mine floor 160, additional overhead clearance is provided between the top of the assemblies and the mine roof 158.

Figure 13:
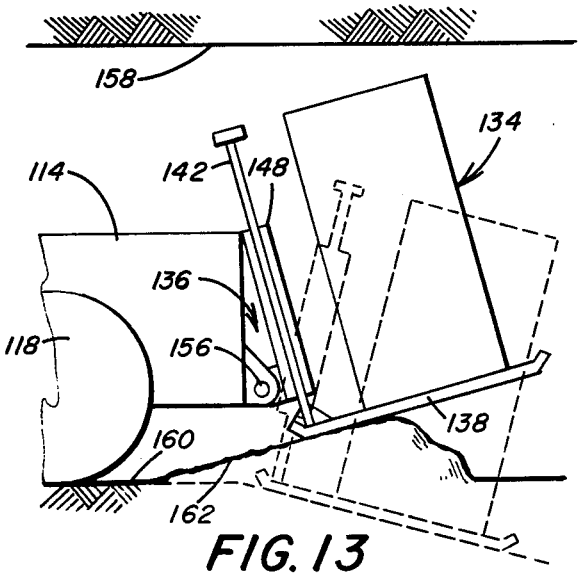
FIG. 13 is a schematic view of the apparatus shown in FIG. 12, illustrating pivotal movement of the roof drilling and bolting unit relative to the vehicle.

When the skid 138 encounters an abrupt change in the elevation in the mine floor 160, such as an obstruction 162 illustrated in FIG. 13, the skid 138 is operable to pivot upwardly and pass over the obstruction as the machine 112 travels on a level portion of the mine floor. As the skid 138 encounters the obstruction 162, the upward force exerted upon the skid 138 is transmitted through the guide rail 142 to the guide member 148. This urges the guide member 148 to pivot about the pivot pin 156 toward the machine body portion 114 and allow the skid 138 to follow the contour of the obstruction. As the machine 114 continues to advance, the skid 138 slides over the obstruction 162 and the guide member 148 pivots about the pivot pin 156. Further, as the machine 114 travels over the obstruction 162, the guide member 148 pivots about the pin 156 to permit the skid 138 to slide into contact with the level portion of the mine floor.

Figure 14:
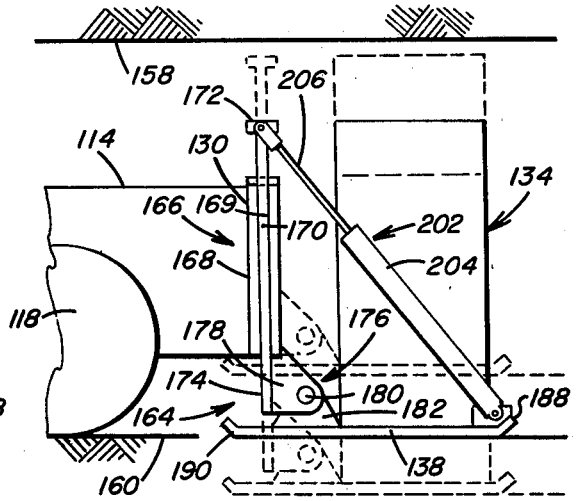
FIG. 14 is a fragmentary schematic view in side elevation of the vehicle shown in FIG. 11, illustrating the upward and downward movement of the roof drilling and bolting unit by operation of the present invention in which the hinge connection is secured to the roof drilling and bolting unit.

Referring to FIG. 14, there is illustrated a connecting apparatus 164 that is also operable to hingedly and slidably connect the drilling and bolting assemblies 132 and 134 to the machine body portion 114. The connecting apparatus 164 includes a slide assembly 166 securely mounted to the end wall 130 of the machine body portion 114. Similar to the slide assembly 140 illustrated in FIG. 12, the slide assembly 166 in FIG. 14 includes a guide member 168 fixed to the end wall 130 in a vertical position. The guide member 168 includes a vertically extending recess 169 arranged to slidably receive a guide rail 170 having an enlarged upper end portion 172 extending above the guide member 168 and a lower end portion 174 that is secured to a hinge assembly 176.

The hinge assembly 176 includes a bracket portion 178 which is connected by a pivot pin 180 to a trunnion 182. The trunnion 182 is secured to the skid 138 that supports the drilling and bolting assembly 134. The pivot pin 180 extends through aligned bores of the bracket portion 178 and trunnion 182 to permit the trunnion 182, together with the skid 138, to pivot relative to the bracket portion 178. This arrangement allows the skid 138 to follow the contour of the mine floor independently of the movement of the machine mobile body portion 114 as it travels along the mine floor, as illustrated in FIG. 15.

As with the embodiment of the present invention illustrated in FIG. 12, the embodiment illustrated in FIG. 14 provides for vertical movement of the guide rail 170 within the recess 169 of the guide member 168. As stated above, this permits the drilling and bolting assembly to move with the skid 138 upwardly and downwardly relative to the machine mobile body 114 independently of the upward and downward movement of the mobile body as it travels over the undulating surface of the mine floor 160. The guide rail 170 is movable upwardly and downwardly through a vertical distance determined by the distance between the enlarged end portion 172 of the guide rail and the top of the guide member 168 at one end of the guide rail and the distance between the hinge assembly 176 and the bottom of the guide member 168 at the opposite end portion of the guide rail. With this embodiment illustrated in FIG. 14 the pivotal axis formed by the pin 180 is vertically movable relative to the machine body portion 114 as opposed to the embodiment of the connecting apparatus 136 illustrated in FIG. 12 where the pivot pin 156 is fixed relative to the machine body portion 114.

Figure 15:
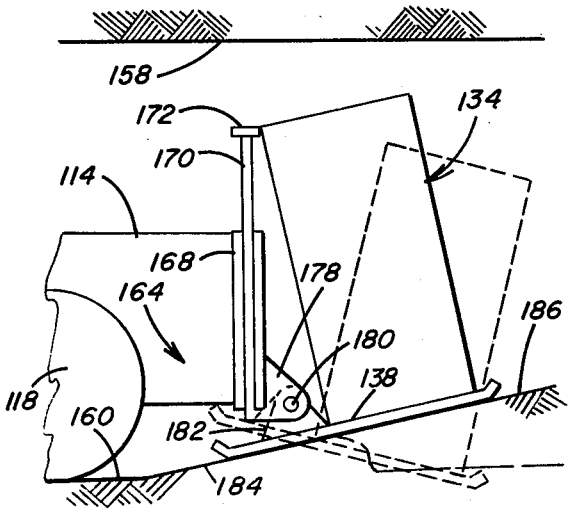
FIG. 15 is a schematic view of the apparatus shown in FIG. 14, illustrating pivotal movement of the roof drilling and bolting unit relative to the vehicle.

As illustrated in FIG. 15, when the skid 138 encounters an obstruction 184 or an inclined slope 186 on the mine floor, the trunnion 182 of the hinge assembly 176 pivots about the pivot pin 180 to permit skid 138 to move from the level portion of the mine floor into slidable contact with the obstruction 184 or inclined slope 186. The guide rail 170 remains slidable within the guide member 168 fixed to the endwall 130 as the skid 138 pivots about pin 180. Thus the pivotal axis of the connecting apparatus 164, illustrated in FIG. 14, is arranged to move upwardly and downwardly relative to the mobile body portion 114.

Referring to FIGS. 12 and 14, there is illustrated another feature of the present invention for pivoting or tilting the skids 138 that slidably support the drilling and bolting units 132 and 134 for movement along the mine floor. The skids 138 each include a forward edge portion 188 and a rearward edge portion 190. The tilting movement of the skid 138 to move only edge portion 188 or 190 into contact with the mine floor for the arrangement illustrated in FIG. 12 is accomplished by a piston cylinder assembly generally designated by the numeral 192. The assembly 192 includes a cylinder portion 194 that is pivotally secured by a conventional clevis-type connection 196 at its base portion to the body portion 114 of the mobile drilling and bolting machine 112. A piston rod 198 is extensible into and out of the opposite end portion of the cylinder portion 194 and is pivotally connected at its extreme end portion to a clevis-type connection 200 secured to the guide member 148 that is pivotally connected to the machine body portion 114 by the hinge assembly 150, in the manner as above discussed.

The piston cylinder assembly 192 is operable in a conventional manner to extend and retract the piston rod 198. With this arrangement by extending the rod 198 from the cylinder portion 194 the guide member 148 is pivoted about the pivot pin 156 away from the machine body portion 114. With the guide rails 142 retained within the recess 146 of the guide member 148, forward pivotal movement of the guide member 148 forwardly pivots the guide rail 142 together with the skid 138, which is secured to the lower end portion of the guide rail 142. Thus by extending the piston rod 198 the skid 138 is forwardly pivoted and preferably the piston rod 198 is extended so that only the skid front edge portion 188 remains in contact with the mine floor.

Conversely, by retracting the piston rod 198 into the cylinder portion 194 the guide member 148 and the guide rail 142 are pivoted rearwardly about the pivot pin 156 toward the machine body portion 114. Preferably, the piston rod 198 is retracted to the extent that only the rearward edge portion 190 of the skid 138 remains in contact with the mine floor 160. With either arrangement, where only the front edge 188 or the rear edge 190 of the skid 138 is in contact with the mine floor, the amount of area of the skid 138 in contact with the mine floor is substantially reduced. Thus the skid is less likely to become impeded by engaging an obstruction or projection on the mine floor as it slides on the mine floor.

In a similar arrangement as illustrated in FIG. 14, a piston cylinder assembly generally designated by the numeral 202 is positioned to facilitate a forward or a backward tilting of the skid 138 to position either the front edge portion 188 or the rearward edge portion 190 in slidable contact with the mine floor. The piston cylinder assembly 202 includes a cylinder portion 204 pivotally secured in a conventional manner adjacent to the forward edge portion 188 of the skid 138. A piston rod 206 is operable to extend out of and retract into the cylinder portion 204. The outer end of the piston rod 206 is connected to the upper end portion of the guide rail 170 in a conventional manner. With the connecting assembly 164 illustrated in FIG. 14, the skid 138 is pivotally connected to the slide assembly 168 by the hinge assembly 176 for pivotal movement relative to the machine body portion 114 about the pivotal axis formed by pivot pin 180.

The bracket portion 178 of the hinge assembly 176 is secured to the lower end portion of the guide rail 170 which is slidable upwardly and downwardly within the recess 169 of the guide member 168 that is secured to the machine body portion 114. Therefore, the trunnion portion 182 which is connected to the skid 138 pivots relative to the bracket portion 178. Thus extension of the piston rod 206 from the piston cylinder 204 pivots the skid 138 away from the machine body portion 114. The rod 206 extends until the skid front edge 188 is the only portion of the skid that remains in slidable contact with the mine floor.

Conversely, retracting the piston rod 206 into the cylinder portion 204 pivots or tilts the skid 138 about the pivot pin 180 toward the machine body portion 114. The piston rod 206 is retracted until the skid rearward edge portion 190 is the only portion of the bottom of the skid 138 that contacts the mine floor. In this manner the connecting apparatus 164 illustrated in FIG. 14, is operable to permit the skid 138 to be tilted by operation of the piston cylinder assembly 202 to a position where only the front edge 188 or the rearward edge 190 contacts the mine floor for slidable movement thereon.

According to the provisions of the Patent Statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. A self-propelled vehicle for use in a mine comprising, a mobile body, traction means for propelling said mobile body along a mine floor, an attachment positioned adjacent to said mobile body, said attachment having a body portion, connecting means for slidably and hingedly connecting said attachment to said mobile body, said connecting means including a slide assembly extending between and connected to said attachment and said mobile body, said slide assembly having a cooperating guide member and guide rail for facilitating upward and downward movement of said attachment relative to said mobile body as said attachment body portion travels over the uneven surface of the mine floor, and a hinge assembly associated with said slide assembly for hingedly connecting said attachment to said mobile body so that said attachment is freely pivotal about a pivotal axis located between said attachment and said mobile body to permit pivotal movement of said attachment relative to said mobile body as said attachment travels over the uneven surface of the mine floor.

2. A self-propelled vehicle for use in a mine as set forth in claim 1 which includes, said connecting means having a first portion connected to said mobile body and a second portion connected to said attachment, said connecting means first and second portions being movable upwardly and downwardly relative to one another to permit said attachment to move upwardly and downwardly relative to said mobile body independently of the upward and downward movement of said mobile body as said attachment slides on the mine floor, and said connecting first and second portions being hingedly connected for pivotal movement of said attachment relative to mobile body to permit said attachment to pivot relative to said mobile body and remain in slidable contact with the mine floor as said attachment slides on the mine floor.

3. A self-propelled vehicle for use in a mine as set forth in claim 1 which includes, said attachment body portion having a bottom portion slidably engageable with the mine floor, said connecting means including a first portion connected to said mobile body and a second portion connected to said attachment, said first and second portions being slidable upwardly and downwardly relative to one another to permit said attachment bottom portion to slide along the mine floor as said mobile body travels over the undulating surface of the mine floor, and said connecting means first and second portions being connected to one another about said pivotal axis for pivotal movement of said attachment relative to said mobile body as said mobile body travels over the undulating surface of the mine floor.

4. A self-propelled vehicle for use in a mine as set forth in claim 1 which includes, said attachment body portion having a bottom portion slidably engageable with the mine floor, said connecting means having a first portion secured to said attachment and a second portion secured to said mobile body, said first and second portions being slidably connected to one another to permit upward and downward movement of said attachment relative to said mobile body so that said attachment bottom portion remains in slidable contact with the mine floor as said mobile body travels over the undulating surface of the mine floor, and said pivotal axis extending horizontally between said attachment and said mobile body to permit said attachment to pivot relative to said mobile body independently of the upward and downward movement of said attachment relative to said mobile body.

5. A self-propelled vehicle for use in a mine as set forth in claim 1 which includes, said attachment body portion having a bottom portion slidably engageable with the mine floor, said bottom portion having a front edge portion and a rear edge portion, said connecting means having a first portion secured to said attachment and a second portion secured to said mobile body, said connecting means first and second portions being connected to one another about said pivotal axis for pivotal movement of said attachment relative to said mobile body, and piston cylinder means associated with said connecting means for actuating pivotal movement of said attachment relative to said mobile body to tilt said attachment to a position where said bottom portion is raised from the mine floor and only a selected one of said front and rear edge portions remains in slidable contact with the mine floor.

6. A self-propelled vehicle for use in a mine as set forth in claim 1 which includes, said slide assembly guide member being secured to said mobile body and said guide rail received by said guide member for upward and downward movement relative to said guide member, said guide rail being pivotally connected to said attachment to form said pivotal axis for pivotal movement of said attachment relative to said mobile body independent of the upward and downward movement of said attachment relative to said mobile body as said mobile body with said attachment connected thereto travels over the uneven contour of the mine floor, and said pivotal axis being movable upwardly and downwardly with said attachment relative to said mobile body.

7. A self-propelled vehicle for use in a mine as set forth in claim 1 which includes, said guide rail being slidably received by said guide member for upward and downward movement of said guide rail relative to said guide member, said guide rail being secured to said attachment, said guide member being pivotally connected to said mobile body to form said pivotal axis for pivotal movement of said attachment relative to said mobile body independent of the upward and downward movement of said attachment relative to said mobile body as said mobile body with said attachment connected thereto travels over the uneven contour of the mine floor, and said pivotal axis being fixed relative to said attachment so that said attachment moves upwardly and downwardly relative to said pivotal axis.

8. A self-propelled vehicle for use in a mine as set forth in claim 1 which includes, said slide assembly guide member being secured to said mobile body and said guide rail being slidably received by said guide member for upward and downward movement relative to said guide member, said hinge assembly having a first portion secured to said attachment and a second portion pivotally connected to said first portion for pivotal movement of said first portion relative to said second portion, and said guide rail being secured to said hinge assembly second portion to permit upward and downward movement of said hinge assembly with said attachment connected thereto relative to said mobile body.

9. A self-propelled vehicle for use in a mine as set forth in claim 8 which includes, a pivot pin pivotally connecting said hinge assembly first portion to said hinge assembly second portion, said pivot pin forming said pivotal axis extending between said attachment and said mobile body, and said pivotal axis being movable upwardly and downwardly with said attachment relative to said mobile body.

10. A self-propelled vehicle for use in a mine as set forth in claim 8 which includes, said attachment body portion having a bottom portion slidably engageable with the mine floor, said bottom portion having a front edge portion and a rear edge portion, and piston cylinder means extending between said attachment and said guide rail for actuating pivotal movement of said attachment relative to said mobile body to tilt said attachment to a position where said bottom portion is raised from the mine floor and only a selected one of said front and rear edge portions remains in slidable contact with the mine floor.

11. A self-propelled vehicle for use in a mine as set forth in claim 1 which includes, said slide assembly guide rail slidably received by said slide assembly guide member for upward and downward movement of said guide rail relative to said guide member, said guide rail being secured to said attachment, said hinge assembly having a first portion secured to said mobile body and a pivot pin, and said pivot pin pivotally connecting said guide member to said hinge assembly first portion for pivotal movement of said attachment relative to said mobile body independent of the upward and downward movement of said attachment relative to said mobile body.

12. A self-propelled vehicle for use in a mine as set forth in claim 11 which includes, said pivot pin forming said pivotal axis extending between said attachment and said mobile body, and said pivotal axis remaining fixed relative to said mobile body with said attachment being movable upwardly and downwardly relative to said pivotal axis.

13. A self-propelled vehicle for use in a mine as set forth in claim 11 which includes, said attachment body portion having a bottom portion slidably engageable with the mine floor, said bottom portion having a front edge portion and a rear edge portion, and piston cylinder means extending between said mobile body and said guide member for actuating pivotal movement of said attachment relative to said mobile body to tilt said attachment to a position where said bottom portion is raised from the mine floor and only a selected one of said front and rear edge portions remains in slidable contact with the mine floor.

14. A self-propelled vehicle for use in a mine as set forth in claim 1 in which said attachment includes, an operator's compartment positioned adjacent to said mobile body, said operator's compartment having a body portion with a floor positioned for slidable movement along the mine floor, and said connecting means being operable to connect said operator's compartment to said mobile body to permit said operator's compartment to move upwardly and downwardly relative to said mobile body and to pivot relative to said mobile body as said mobile body with said operator's compartment connected thereto travels over the undulating surface of the mine floor.

15. A self-propelled vehicle for use in a mine as set forth in claim 1 in which said attachment includes, a roof drilling and bolting assembly, said roof drilling and bolting assembly positioned adjacent to said mobile body, means for slidably supporting said roof drilling and bolting assembly on the mine floor, and said connecting means being operable to connect said assembly to said mobile body to permit said assembly to move upwardly and downwardly relative to said mobile body and to pivot relative to said mobile body as said mobile body with said assembly connected thereto travels over the undulating surface of the mine floor.

16. A self-propelled vehicle for use in a mine comprising, a mobile body, traction means for propelling said mobile body along a mine floor, an attachment positioned adjacent to said mobile body, said attachment having a body portion, connecting means for slidably and hingedly connecting said attachment to said mobile body, said connecting means including a slide assembly having a guide member secured to said mobile body and a guide rail received by said guide member for upward and downward movement relative to said guide member, said guide rail being pivotally connected to said attachment to form a pivotal axis for pivotal movement of said attachment relative to said mobile body independent of the upward and downward movement of said attachment relative to said mobile body as said mobile body with said attachment connected thereto travels over the uneven contour of the mine floor, and said pivotal axis being movable upwardly and downwardly with said attachment relative to said mobile body.

17. A self-propelled vehicle for use in a mine as set forth in claim 16 in which, said connecting means includes a hinge assembly, said hinge assembly having a first portion secured to said attachment and a second portion pivotally connected to said first portion for pivotal movement of said first portion relative to said second portion, and said guide rail being secured to said hinge assembly second portion to permit upward and downward movement of said hinge assembly with said attachment connected thereto relative to said mobile body.

18. A self-propelled vehicle for use in a mine as set forth in claim 17 which includes, a pivot pin pivotally connecting said hinge assembly first portion to said hinge assembly second portion, said pivot pin forming said pivotal axis extending between said attachment and said mobile body, and said pivotal axis being movable upwardly and downwardly with said attachment relative to said mobile body.

19. A self-propelled vehicle for use in a mine as set forth in claim 17 which includes, said attachment body portion having a bottom portion slidably engageable with the mine floor, said bottom portion having a front edge portion and a rear edge portion, and piston cylinder means extending between said attachment and said guide rail for actuating pivotal movement of said attachment relative to said mobile body to tilt said attachment to a position where said bottom portion is raised from the mine floor and only a selected one of said front and rear edge portions remains in slidable contact with the mine floor.

20. A self-propelled vehicle for use in a mine comprising, a mobile body, traction means for propelling said mobile body along a mine floor, an attachment positioned adjacent to said mobile body, said attachment having a body portion, connecting means for slidably and hingedly connecting said attachment to said mobile body, said connecting means including a slide assembly having a guide member and a guide rail, said guide rail being slidably received by said guide member for upward and downward movement of said guide rail relative to said guide member, said guide rail being secured to said attachment, said guide member being pivotally connected to said mobile body to form a pivotal axis for pivotal movement of said attachment relative to said mobile body independent of the upward and downward movement of said attachment relative to said mobile body as said mobile body with said attachment connected thereto travels over the uneven contour of the mine floor, and said pivotal axis being fixed relative to said attachment so that said attachment moves upwardly and downwardly relative to said pivotal axis.

21. A self-propelled vehicle for use in a mine as set forth in claim 20 in which, said connecting means includes a hinge assembly, said guide rail being secured to said attachment, said hinge assembly having a first potion secured to said mobile body and a pivot pin, and said pivot pin pivotally connecting said guide member to said hinge assemby first portion for pivotal movement of said attachment relative to said mobile body independent of the upward and downward movement of said attachment relative to said mobile body.

22. A self-propelled vehicle for use in a mine as set forth in claim 21 which includes, said pivot pin forming said pivotal axis extending between said attachment and said mobile body, and said pivotal axis remaining fixed relative to said mobile body with said attachment being movable upwardly and downwardly relative to said pivotal axis.

23. A self-propelled vehicle for use in a mine as set forth in claim 21 which includes, said attachment body portion having a bottom portion slidably engageable with the mine floor, said bottom portion having a front edge portion and a rear edge portion, and piston cylinder means extending between said mobile body and said guide member for actuating pivotal movement of said attachment relative to said mobile body to tilt said attachment to a position where said bottom portion is raised from the mine floor and only a selected one of said front and rear edge portions remains in slidable contact with the mine floor.

* * * * *

UNITED STATES PATENT OFFICE
CERTIFICATE OF CORRECTION

PATENT NO. : 4,157,878
DATED : June 12, 1979
INVENTOR(S) : Will B. Jamison

It is certified that error appears in the above-identified patent and that said Letters Patent are hereby corrected as shown below:

Abstract; line 23: "edge of the" should read --edge or the--

Col. 18; line 22: "potion" should read --portion--

Signed and Sealed this

Ninth Day of October 1979

[SEAL]

*Attest:*

RUTH C. MASON
*Attesting Officer*

LUTRELLE F. PARKER
*Acting Commissioner of Patents and Trademarks*